US006994327B2

(12) United States Patent
Steffes

(10) Patent No.: US 6,994,327 B2
(45) Date of Patent: Feb. 7, 2006

(54) CAP AND BASE ASSEMBLY FOR A FENCE POST

(75) Inventor: Stephen W. Steffes, McPherson, KS (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 10/640,132

(22) Filed: Aug. 13, 2003

(65) Prior Publication Data

US 2005/0035339 A1 Feb. 17, 2005

(51) Int. Cl.
*E04H 17/14* (2006.01)

(52) U.S. Cl. ..... 256/19; 256/1; 256/66

(58) Field of Classification Search ..... 256/1, 256/19, 66

See application file for complete search history.

(56) References Cited

U.S. PATENT DOCUMENTS 5,419,536 A * 5/1995 Bender ..... 256/1
5,421,556 A * 6/1995 Dodge et al. ..... 256/1
5,660,376 A 8/1997 West
5,702,090 A 12/1997 Edgman
5,853,167 A * 12/1998 West et al. ..... 256/66
5,873,671 A 2/1999 West
6,039,307 A 3/2000 De Zen
6,076,807 A 6/2000 Spence
6,557,829 B1 5/2003 Steffes
2002/0125468 A1 * 9/2002 Fischer ..... 256/19
2003/0122115 A1 * 7/2003 Ernst et al. ..... 256/1

* cited by examiner

*Primary Examiner*—Daniel P. Stodola
*Assistant Examiner*—Victor MacArthur
(74) *Attorney, Agent, or Firm*—Paul & Paul

(57) ABSTRACT

A cap assembly for a fence post comprises a molded upper base member, with a molded cap, preferably snapped together by internal prong-and-ear fasteners, or molded as a single piece, or as vertical halves fastened together. Various ornamental configurations are disclosed, such as New England cap, Ball cap or Gothic Spire cap. The components are brought together to make a hollow structure giving the appearance of a machined wood or plastic ornamental fence post cap.

8 Claims, 5 Drawing Sheets

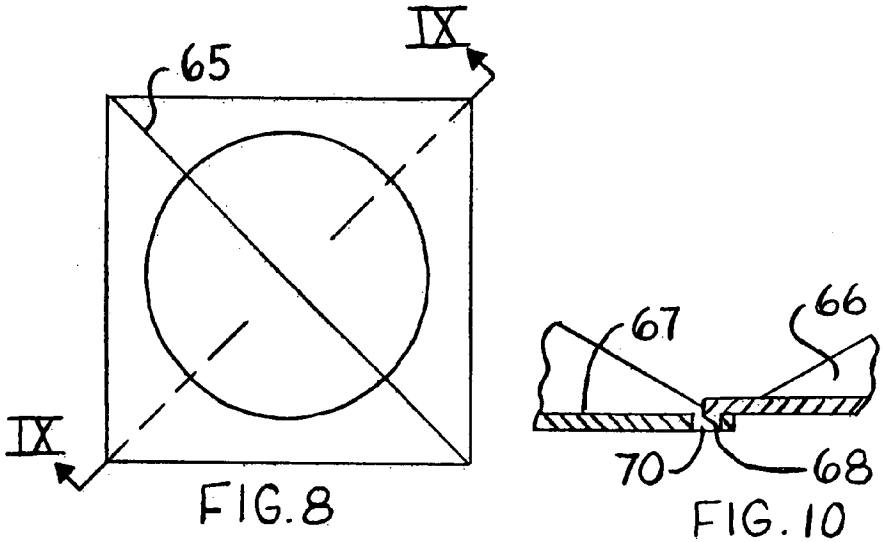
FIG. 10
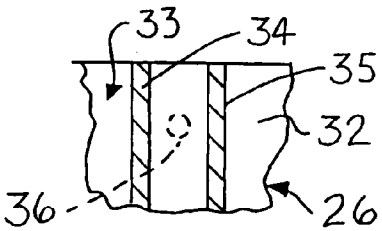
FIG. 4
FIG. 8
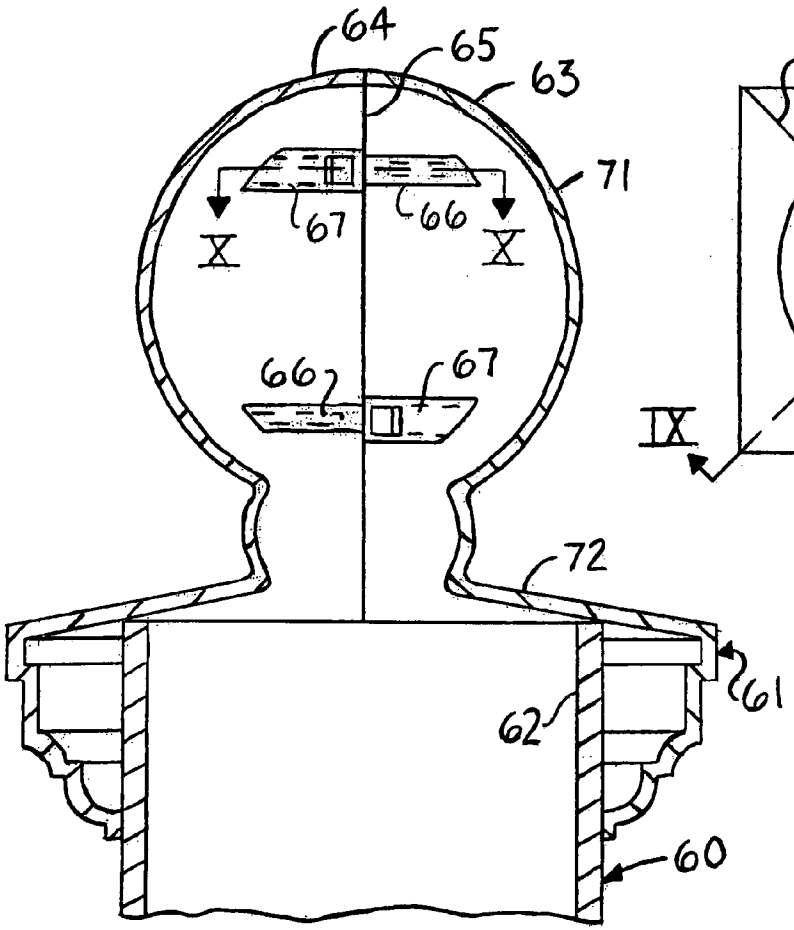
FIG. 9

CAP AND BASE ASSEMBLY FOR A FENCE POST

BACKGROUND OF THE INVENTION

It is known in the art of fence manufacture that fences are generally constructed with in ground posts extending vertically upward, connected by generally horizontal upper and lower rails, with generally vertical slats connecting the upper and lower rails. For decorative reasons, caps are provided for the fence posts, which caps can take on various configurations.

In the fence art, traditionally the fences have been of wooden construction.

With the availability of thermoplastics, vinyl and other materials which offer the prospect of reduced maintenance relative to the maintenance generally required for wooden fences, it has become known in the art that fence posts, rails, slats, caps and decorative cap bases can be molded from various thermoplastic and/or vinyl materials, so as to provide decorative fence components that can be efficiently assembled relative to the traditional nailing assemblies used for wooden fences.

SUMMARY OF INVENTION

The present invention is directed to providing a cap assembly for a fence post having a preferably decorative molded upper base and a separate molded cap, with interconnecting prong and ear means for connecting the base and cap together for disposition on top of a fence post.

Accordingly, it is an object of this invention to provide a readily assembleable cap assembly for a fence post comprising a molded base and a molded cap, with means readily connecting the same.

It is a further object of this invention to accomplish the above object, wherein the assembly is essentially hollow, and having strengthening internal supports.

It is another object of this invention to provide a one-piece hollow cap and upper base combination for a fence post.

It is a further object of this invention to provide a cap assembly for a fence post, that comprises two molded members, each of which includes a portion of a cap and a portion of an upper base, which members are readily fastenable together.

It is another object of this invention to accomplish the object, wherein the assembly is substantially hollow, with interconnecting prong-and-ear means disposed therein.

It is a further object of this invention to accomplish the two objects set forth immediately above, wherein the separate members are connected along a generally vertical plane.

It is a further object of this invention to accomplish the above objects, wherein various configurations are possible for the fence post cap, including the New England cap style, the Ball Cap style, and the gothic spire cap style.

Other objects and advantages of the present invention will be readily apparent upon a reading of the following brief descriptions of the drawing figures, the detailed descriptions of the preferred embodiments, and the appended claims.

BRIEF DESCRIPTIONS OF THE DRAWING FIGURES

FIG. 4 is a fragmentary, detail illustration through the upper base member, taken generally along the line IV—IV of FIG. 3.

FIG. 8 is a top plan view of an alternative embodiment of a fence cap and upper base assembly, having a fence cap configuration of the bally type.

FIG. 9 is an enlarged fragmentary vertical sectional view, taken along the line of IX—IX of FIG. 8, and wherein the prong-and-ear interconnection of the two halves of the assembly of FIG. 8, across a parting line, are illustrated.

FIG. 10 is an enlarged fragmentary sectional view taken through the prong-and-ear fastening means of FIG. 8, generally along the line X—X of FIG. 9.

DETAILED DESCRIPTIONS OF THE PREFERRED EMBODIMENTS

Figure 1:
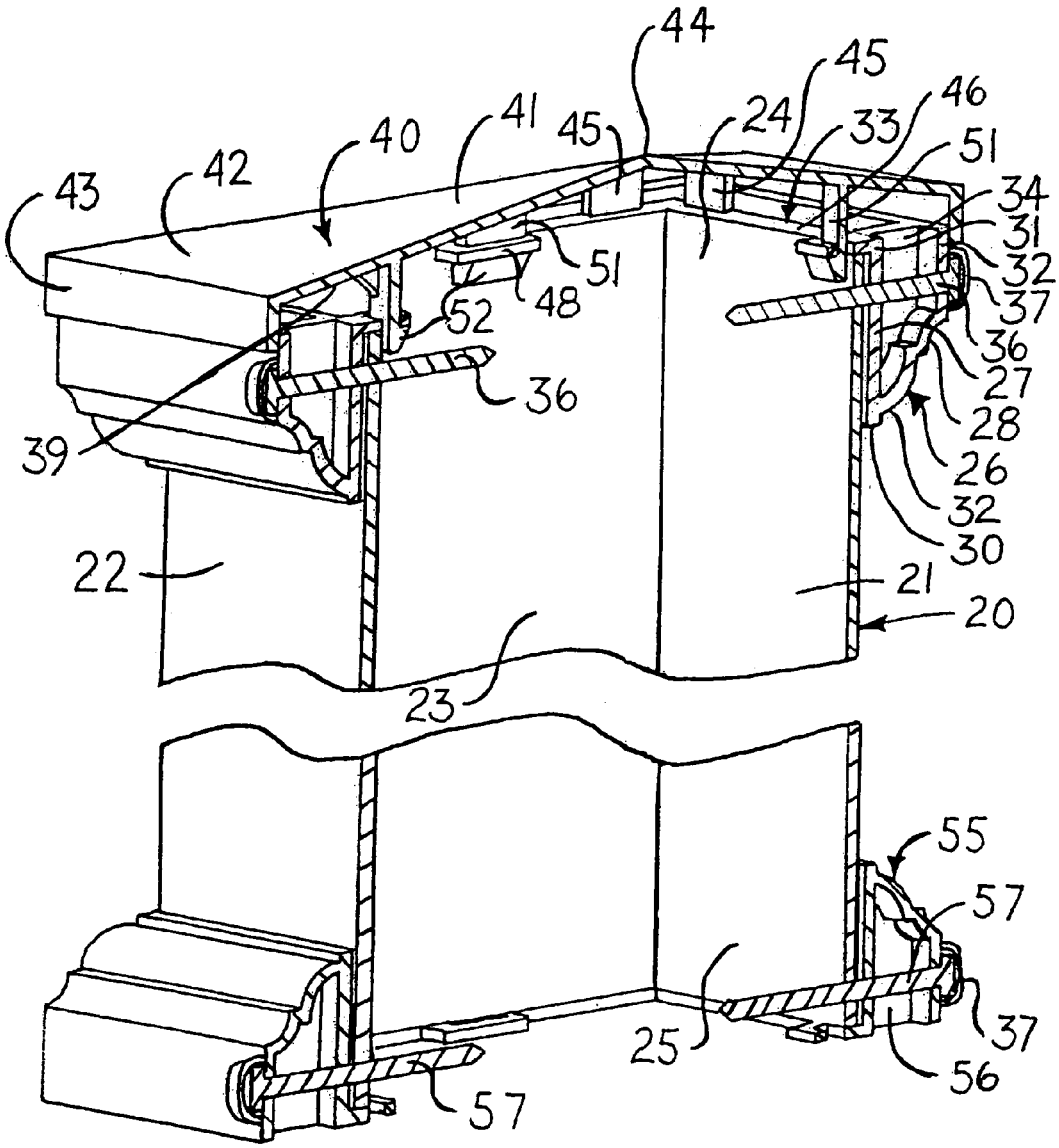
FIG. 1 is a perspective view, partially in section of a vertical fence post having upper and lower bases disposed thereabout, with a New England style fence cap overlying the upper end of the post and the upper base, with the post being fragmentally illustrated in two separate parts, to illustrate a fence post of indeterminate length.
Figure 3:
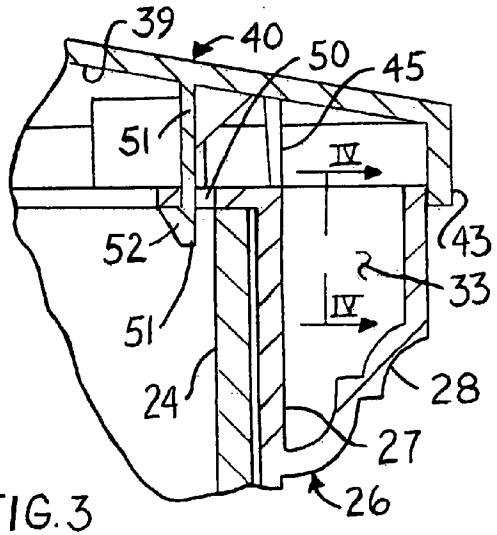
FIG. 3 is an enlarged fragmentary, detail view, in vertical section, of the interconnection effected by the prong-and-ear fastener whereby the cap is secured to the upper base member.

Referring now to the drawings in detail, reference is first made to FIG. 1, wherein a plastic (thermoplastic) fence post 20 is illustrated as being vertically disposed.

The fence post 20 is shown as being of the molded type, preferably rectangular in configuration and having right and left sidewalls 21 and 22, connected by a front wall (not shown) and a rear wall 23. The post 20 is fragmentally illustrated, to encompass a post of any desired length, between upper and lower ends 24, 25, respectively. Other cross-sectional configurations may also employ features of this invention. Such configurations may be circular, oval, triangular, rhomboidal or other shapes.

A molded upper base member 26 is shown, also generally rectangular in configuration to fit just outside the four walls of the post 20, about its upper end 24.

The upper base member 26 has a generally vertically disposed inner wall 27 which is continuous and unbroken around the exterior of the post 20, extending from a lower end 30 where it is integrally connected with the outer wall 28, to the upper end 31 of the inner wall, terminating in a continuous flat upper edge 46 to provide the desired rigidity for the upper base member 26.

The outer wall 28 of the upper base member 26 is decoratively configured on its surface 32, to simulate a molding of a desired ornamental configuration, and extends from its lower end connection 30 with the inner wall 27, to its upper end 32. The upper ends 31 and 32 of the inner and outer walls 27, 28, respectively, are thus spaced apart to define therebetween a generally rectangular trench 33, such that the upper base member 32 is generally hollow, as shown.

On each of the four sides of the upper base member 26, generally centrally of each side, there are a pair of spaced apart ribs 34, 35, extending between the inner wall 31 and the outer wall 32, straddling a fastener 36, to provide rigidifying support, particularly for the outer wall 32, as fasteners 36, preferably of the screw variety, are driven through the upper base member 26, as shown in FIG. 1, for fastening the upper base member 26 to the walls of the post 20, as shown. In the illustration of FIG. 4, the screw 36 is shown in phantom, so that its placement can be clearly understood.

After the screws or other fasteners 36 are applied, as shown in FIG. 1, decorative covers 37 may be applied over the heads thereof, as may be desired.

A molded plastic (thermoplastic) cap 40 is provided, in snap-fit engagement with the upper base member 26.

The cap 40 has an upper surface 41 and a lower surface 39. The upper surface 41, as shown in FIG. 1 is comprised of four triangular components 42, which run from a downwardly depending rectangular lip 43, to an apex 44, to form a configuration that is known as the New England type of cap. The depending lip 43 extends entirely around the upper end 32 of the outer wall 28, as shown.

Extending downwardly from the lower surface 39 of the cap 40, are a plurality of standoff legs 45, integrally molded with the lower surface 39 of the cap, and which engage against the upper edge 46 of the inner wall 27, to support the cap 40 from the upper end 24 of the post 20.

Each of the walls 21, 22 and 23 and the front wall (unnumbered) as shown in FIG. 1 of the post 20 are provided, centrally thereof, with inwardly projecting ears 48, integrally formed with the upper base member 26, and being generally horizontally extensive, inwardly of the post 20, each with an opening 50 therein, for receipt of depending prongs 51 that, in turn, extend downwardly from and are integrally formed with the cap 20, beneath the lower surface 39 thereof. Each prong 51 is provided with a locking means 52 in the form of a projection, inwardly as shown in FIGS. 1, 2, 3, 6 and 7 such that, when each prong 51 is disposed within its associated opening 50, the projection 52 will lock the prong 51 therein, against the undersurface of each ear, to resist removal of the cap 40 upon being pulled upwardly.

Figure 5:
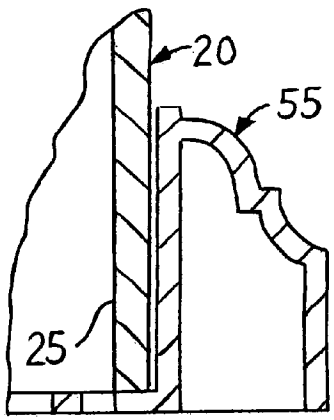
FIG. 5 is an illustration like that of FIG. 3, but of the lower base member disposed about the lower end of the post.
Figure 2:
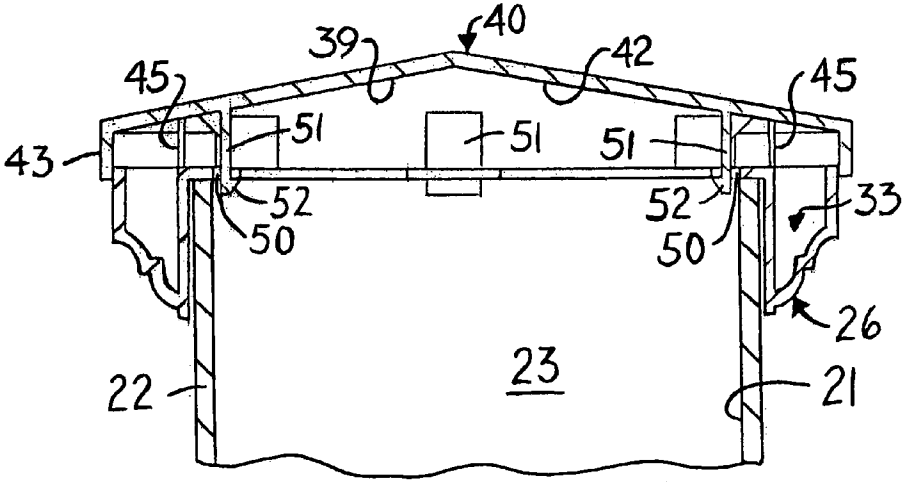
FIG. 2 is a vertical sectional view, through the fence post, bases and cap of FIG. 1.
Figure 2:
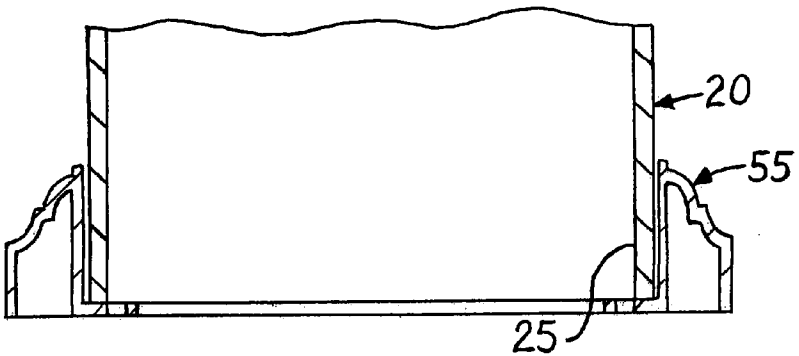
Figure 6:
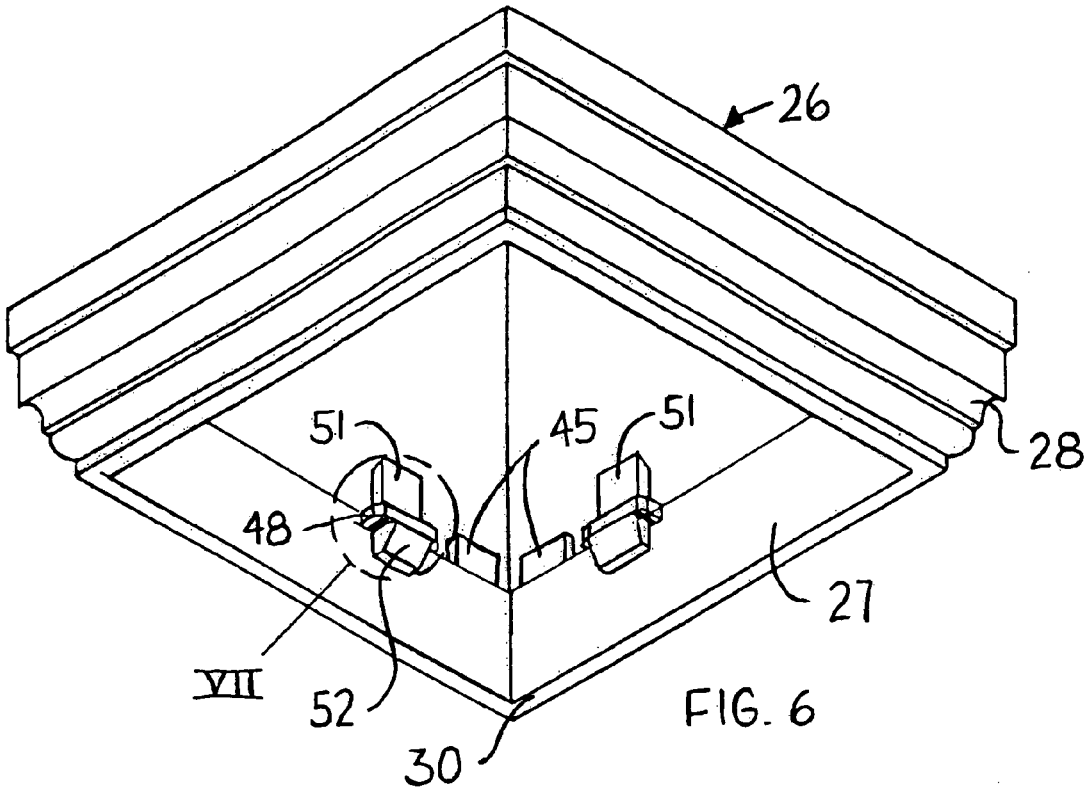
FIG. 6 is a bottom perspective view, looking upwardly through the upper base member at the cap, wherein the prong-and-ear fastening means is more clearly illustrated.
Figure 7:
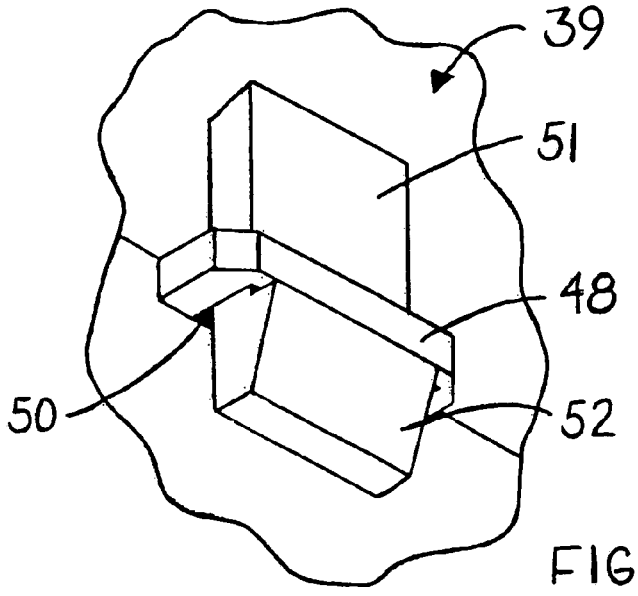
FIG. 7 is an enlarged detail view of that portion of the illustration of FIG. 6 that is designated as VI.
Figure 11:
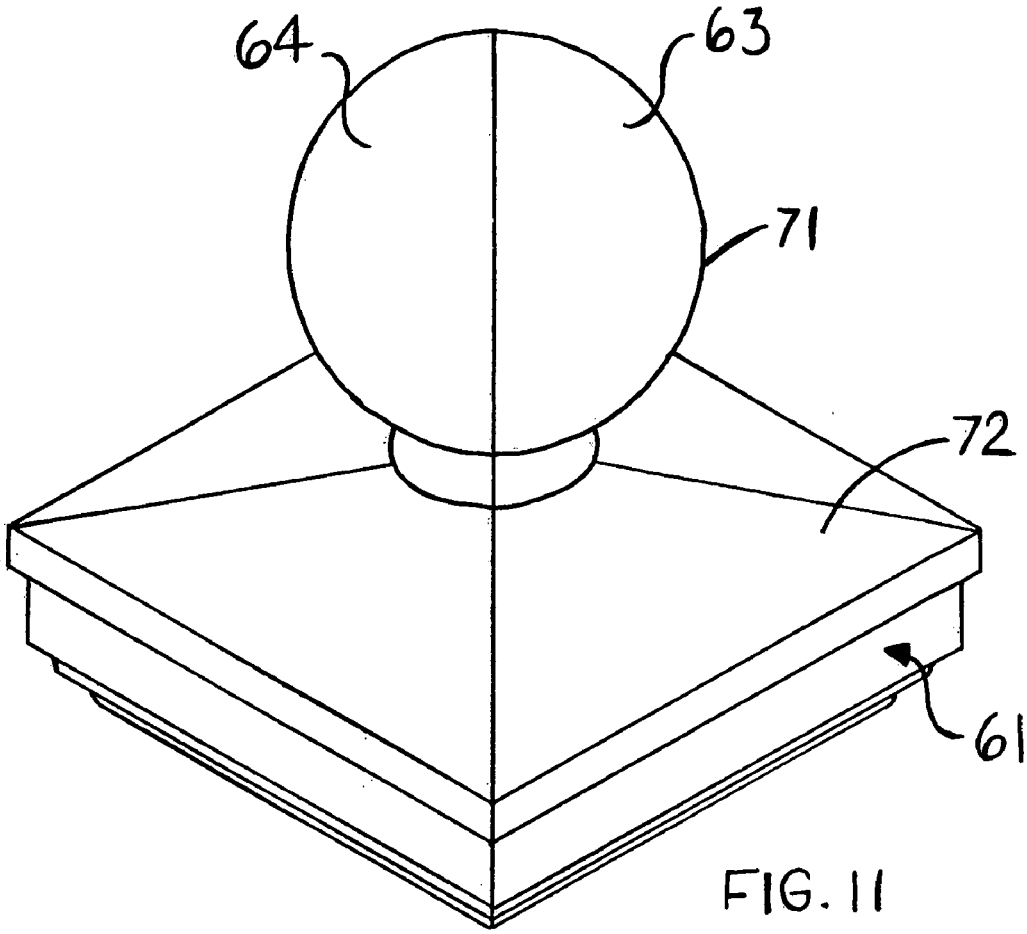
FIG. 11 is a perspective view of the fence cap and upper base member of FIGS. 8 and 9.

A lower base member 55 is provided, as shown in FIGS. 1, 2 and 5, constructed essentially the same as the upper base member 26, but is shown being disposed about the lower end 25 of the post 20, but inverted relative to the disposition of the upper base member 26, with its trench 56 facing downwardly. Otherwise, the lower base member 55 is of substantially identical construction to that of the upper base member 26, so that the details thereof will not be repeated herein. Similarly, the lower base member 55 is provided with fasteners 57, preferably of the screw type, for fastening the lower base member 55 to the lower end 25 of the post 20, as shown in FIG. 1.

Alternatively to use of fasteners 36, 57 of the preferably screw type, nails may instead be used, or an adhesive used between the inner surfaces of the walls 31 of the base members 26, 57 and the covered outer surfaces of the upper ends 24 and lower ends 25 of the post 20, for an alternative means of securing the base members to the post, at opposite ends thereof.

Referring now to FIGS. 8–11 an alternative embodiment of the invention is provided, wherein a post, constructed generally like post 20, is generally designated by the numeral 60, and has a combination upper base and cap arrangement 61 applied to the upper end 62 of the post, as shown in FIG. 9, but wherein the combination cap-and-base assembly 61 is comprised of two generally vertically disposed halves 63, 64, connected along a generally vertical plane 65, to form a combined, one-piece assembly 61.

Each of the two halves 63, 64 of the cap-and-upper base member, is molded, preferably from a plastic (thermoplastic) or vinyl material, to snap together along the parting line comprised of the vertical plane 65.

It will be noted that the vertical plane 65 is along a diagonal line that runs from the upper left of FIG. 8, to the lower right, as shown.

Connecting the two halves 63, 64 of the cap-and-base combination 61, is effected by means of a plurality of prongs 66 in fastened engagement with ears 67 along opposite sides of the plane 65. The prongs 66 and ears 67 are integrally molded with whichever halves 63, 64 of the combination unit 61 from which they are carried.

With particular reference to FIG. 10, it will be seen that each prong is provided with a projection 68 for engagement within an opening 70 of a mating ear 67, to resist a separation movement that might be applied to separate the halves 63, 64 outwardly of the mating plane 65.

In a preferred embodiment, each half will be substantially geometrically identical, where the part will have both a prong and an ear placed so as to join along the mating plane when the two parts are assembled. A further advantage of this embodiment is that a single mold can be used to produce a piece which could serve as either half of the finished cap.

Alternatively, a first part may be disposed with prong means and a second part may be disposed with ear means for locking the two parts together to form the assembled post cap.

In the embodiment of FIG. 8–11, it will be seen that the cap is of the Ball type, having a spherical portion 71 at the upper end, disposed above a flatter portion 72, in order to provide an alternative aesthetic or ornamental cap structure as shown in FIGS. 8–11.

Figure 12:
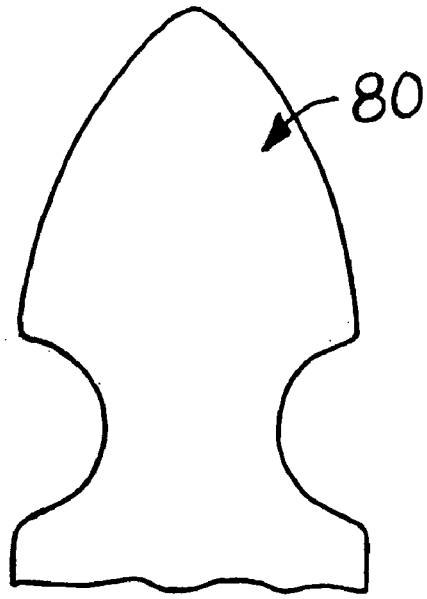
FIG. 12 is an illustration of the upper portion of another decorative fence cap embodiment, wherein the gothic spire type of fence cap decoration is illustrated.

With reference now to FIG. 12, it will be seen that a Gothic Spire configuration is shown, as an alternative to the Ball configuration 71 at the top of the flatter portion 72 of the combined cap and upper base member 61.

In the embodiment of FIG. 12, the flatter portion comparable to that 72 of FIG. 9 is not illustrated, but it will understood that in the embodiment of FIG. 12, all other features are present as they are in the embodiment of FIGS. 8–11, except that in place of the ornamental Ball configuration 71, there is provided the Gothic Spire configuration 80, as shown in FIG. 12.

In each of the embodiments of FIGS. 8–12, the components will be molded, preferably from plastic (thermoplastic) or vinyl material, as described above.

It will thus be seen, that for the cap and upper base embodiments of this invention, there are presented, alternatives whereby the items can be molded to be hollow, with the snap-type locking means of the prong-and-ear type provided inside the components, to present them as hidden from view in use. Thus, the final result gives the appearance of a solid core cap that is machined from a block of wood or plastic, whereas the components are hollow to allow for an economical method of manufacture, such as injection molding of conventional types, or gas assist injection molding technology, even for creation of a single piece cap and upper base member.

It will be apparent from the foregoing that various modifications may be made in the details of construction, in the materials used, and the arrangement of parts, all within the spirit and scope of the invention, as defined in the appended claims.

What is claimed is:

1. A cap assembly for a fence post comprising:

(a) a molded upper base member, with said upper base member including a continuous, unbroken inner wall having upper and lower ends and being coextensive between said upper and lower ends, and an outer wall having upper and lower ends and being coextensive between said upper and lower ends, with said walls being connected at their lower ends and being generally spaced apart at their upper ends to define an upwardly facing trench therebetween;

(b) with the base member being adapted to be disposed about an upper end of a generally vertical post;

(c) a molded cap separate from the upper base member and having top and bottom surfaces adapted to be disposed over an upper end of a generally vertical post and overlying said base member between its said walls and covering said trench;

(d) fastening means for fastening the upper base member to a post;

(e) prong means depending from the bottom surface of said cap;

(f) ear means carried by the upper base member and projecting inwardly beneath the bottom surface of the cap;

(g) with said ear means having opening means therein for receipt of said prong means therein; and (h) said prong means having locking means carried thereby for resisting removal of said prong means from said opening means after receipt of said prong means in said opening means.

2. The cap assembly of claim 1, including standoff means carried by the bottom surface of the cap and adapted to engage the upper end of the inner wall of said base member, to support the cap above and on the upper base member in the assembly.

3. The cap assembly of claim 1, wherein internal rib means are provided between the inner and outer walls of said base member for supporting the outer wall when the assembly is applied to a post.

4. The cap assembly of claim 3, wherein the rib means are provided in pairs for receipt of a fastener therebetween.

5. The cap assembly of claim 1, including angled support means extending between said prong means and the bottom surface of said cap.

6. A fence post assembly comprising a generally vertical fence post, a cap assembly according to claim 1, and a molded lower base member constructed in accordance with clause (a) of claim 1 and disposed about the lower end of the fence post, inverted relative to the upper base member, with the trench of the lower base member facing downwardly.

7. The fence post assembly of claim 6, wherein the fastening means comprises screws.

8. The fence post assembly of claim 6, wherein the fastening means comprises adhesive.

* * * * *